United States Patent [19]

Lyons

[11] Patent Number: 4,546,855

[45] Date of Patent: Oct. 15, 1985

[54] SAFETY EXTENSION FOR A FIXED LADDER WITH AN ADJUSTABLE MOUNT

[75] Inventor: Robert J. Lyons, Hamden, Conn.

[73] Assignee: The Bilco Company, New Haven, Conn.

[21] Appl. No.: 406,359

[22] Filed: Aug. 9, 1982

Related U.S. Application Data

[63] Continuation-in-part of Ser. No. 308,946, Oct. 5, 1981, abandoned.

[51] Int. Cl.[4] ..... E06C 5/36; E06C 7/18

[52] U.S. Cl. ..... 182/106; 182/93; 182/8

[58] Field of Search ..... 182/106, 8, 121, 122, 182/82, 214, 129, 93; 248/210, 238

[56] References Cited

U.S. PATENT DOCUMENTS

| | | | |
|---|---|---|---|
| 719,183 | 1/1903 | Buell | 182/212 |
| 1,104,996 | 7/1914 | McHale | 248/238 |
| 2,641,401 | 6/1953 | James | 182/189 |
| 2,756,955 | 7/1956 | Chadowski | 248/230 |
| 3,033,309 | 5/1962 | Fugere | 182/189 |
| 3,131,928 | 5/1964 | Whipple | 182/106 |
| 3,372,772 | 3/1968 | Singer | 182/129 |
| 3,455,414 | 7/1969 | Higgins | 182/106 |
| 3,598,200 | 8/1971 | Thompson | 182/8 |
| 3,762,500 | 10/1973 | Sarno | 182/214 |
| 4,193,475 | 3/1980 | Sweet et al. | 182/8 |

*Primary Examiner*—Reinaldo P. Machado
*Attorney, Agent, or Firm*—Anthony P. DeLio

[57] ABSTRACT

A safety extension is adapted to be mounted by various adjustable means to the upper rungs of a ladder or the inside of a manhole. The safety extension comprises a rod which is moveable in a sleeve between extended and retracted positions. A counterbalance means mounted in a particular manner is optionally provided to facilitate moving the rod to the extended position with maximum ease and safety. Adjustable mounting means are provided to accommodate ladders of differing rung spacing and rung diameter.

19 Claims, 31 Drawing Figures

SAFETY EXTENSION FOR A FIXED LADDER WITH AN ADJUSTABLE MOUNT

CROSS-REFERENCES TO RELATED APPLICATIONS

This is a continuation-in-part application of co-pending U.S. patent application Ser. No. 308,946, filed Oct. 5, 1981, now abandoned.

BACKGROUND OF THE INVENTION

This invention relates to a safety extension with an adjustable mount which may be attached to a ladder, rigidly mounted in a fixed position, leading into a manhole, or the like. More particularly, this invention relates to a a safety extension with an adjustable mount, the safety extension of the type which may be extended to provide a safety rail for ingress and egress to and from a manhole or like below level passageway.

There are a number of prior art devices which are directed to providing for increased ladder use safety. In general, some of the devices provide a rail or auxiliary support so that the ladder user can grasp the rail and thus improve his balance and stability while using the ladder. Some prior art devices also essentially extend the useful extent of the ladder by providing a support means at the upper extremes of the ladder or the manhole.

The ladders which are commonly employed in manholes, hatchways, below level passageways, and other similar restricted passageways are frequently rigidly mounted in a fixed position with respect to the entranceway. The use of such ladders present a number of practical problems especially with respect to safety, that may not be present with other more conventional ladders. Generally, the fixed ladder may be mounted in such a way that the ladder is wholly confined within the manhole or passageway as opposed to extending through the entrance to the manhole or passageway. Such a ladder orientation necessarily presents an abnormally awkward maneuver for the user in the initial and final stages of interaction with the ladder. For example, when descending from ground level into a manhole, it is usually necessary for the user to seek the support of either an auxiliary structure above the street level or a second individual to prevent accidental falling or slipping during the initial descending process. The latter situation is exacerbated by the not infrequent case where the ladder user is also transporting tools and various working materials to the manhole. It is, therefore, readily apparent that a safety device for use in connection with a manhole ladder should be constructed of rugged materials to withstand heavy duty use. The safety device necessarily, when employed in an environment such as a manhole, should, at a minimum, be capable of extension when being used and of retraction to a position below street level when not in use. It can also be seen that a safety device which is capable of relatively easy extension and retraction may obviate the need for a second individual to assist the first individual in descending into the manhole.

While there have been attempts to adapt safety devices to the specific requirements of a fixed ladder or the walls of a manhole, the prior art is deficient with respect to devices specifically suitable for use in a manhole environment. The deficiencies of the prior art are particularly manifest in safety devices and similar apparati which are neither particularly adaptable to be constructed of rugged materials nor easy to operate. Many of the safety devices adapted for fixed ladders are overly complicated, unsafe, and neither efficient in operation nor easy to attach to the manhole ladder or manhole. The attachment of prior safety devices to these fixed ladders has proved to be both time consuming and burdensome due to the fact that the ladders may have varying rung spacings and rung diameters which necessitates expensive, field fitting or custom hardward for specific installations.

The present invention provides a new and improved safety extension particularly adapted for use in connection with manholes and ladders, which represents an advance over prior art safety devices by virtue of the rugged material construction and the adjustable means of attachment.

SUMMARY OF THE INVENTION

The invention comprises a sleeve provided with means for adjustably mounting the sleeve to adjacent rungs of a ladder to accommodate ladders having varying rung spacing and rung diameters. The safety extension includes a rod slidably received in the sleeve, a means to secure the rod in an extended position relative to the sleeve and an adjustable mount secured to the sleeve suitable for the attachment to a ladder with varying rung spacing and varying rung diameter. A counterbalance means, preferably in the form of a coiled spring, is provided which facilitates the movement of the rod from the retracted position to the extended position. The counterbalance means also acts to retard the downward movement of the rod when the rod is being retracted. The rod is moveable from the extended position to the retracted position upon release of a latch. The adjustable mount, in a preferred embodiment, includes a longitudinally extending channel means secured to the sleeve, at least two spaced apart means for gripping a ladder rung and adjustment means associated with the channel means to permit movement of at least one of the means for gripping a ladder rung to provide longitudinal movement thereof so as to accommodate a given ladder rung spacing.

DETAILED DESCRIPTION

Figure 1:
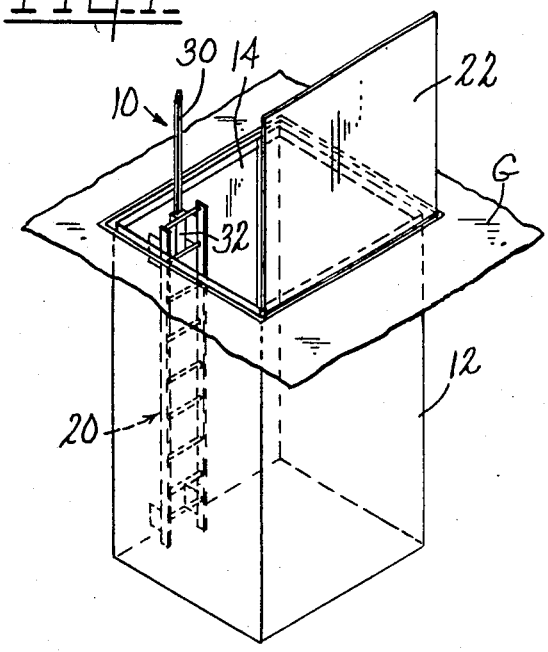
FIG. 1 is a perspective view of a preferred form of the safety extension illustrated in conjunction with a manhole including a fixed ladder and cover, parts of the drawing being illustrated in phantom.

The safety extension shown generally as 10 may be best appreciated by reference to its preferred environment as illustrated in FIG. 1. A subterranean passageway 12 having a ground level opening 14 is provided with a ladder 20 mounted in a fixed, permanent manner to a wall of the passageway. Safety extension 10 is mounted at the top of ladder 20, as will be described below. A portion of the safety extension 10 extends through opening 14 above ground G. A door generally shown as 22 and illustrated in an open position in FIG. 1, provides access to opening 14 and passageway 12.

It will be appreciated that the latter description may be applicable to a manhole, hatchway, or any number of other environments characterized by a substantially restricted passageway in which access is facilitated by means of a rigidly mounted ladder in fixed position relative to the entrance opening. For purposes of illustration only, the safety extension will be described primarily in relation to a subterranean passageway commonly known as manhole, it being understood that such illustrations should not be viewed as a limitation as to the scope or application of the invention.

Figure 2:
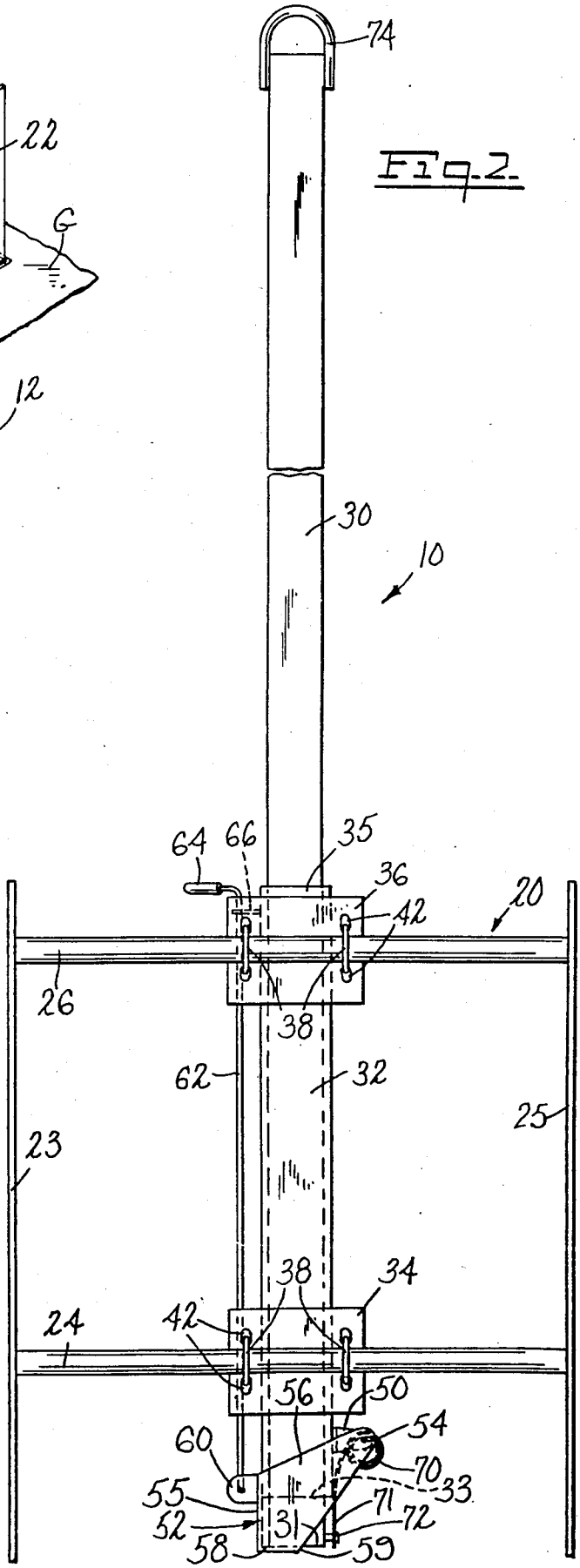
FIG. 2 is a front elevational view of a preferred form of the safety extension attached to the top rungs of a ladder, showing the extension in an extended position.

With reference to FIG. 2, ladder 20 of a conventional form and preferably suitable for heavy duty use has sides 23 and 25 and rungs 24 and 26. In a preferred application safety extension 10 is mounted at the top of the ladder centrally positioned between sides 23 and 25.

Safety extension 10 comprises a rod slidably received in sleeve 32. In preferred form rod 30 and sleeve 32 have a rectangular cross-section as further illustrated in FIG. 5. Sleeve 32 is of a length greater than the distance between adjacent rungs 24 and 26 of the ladder.

Figure 5:
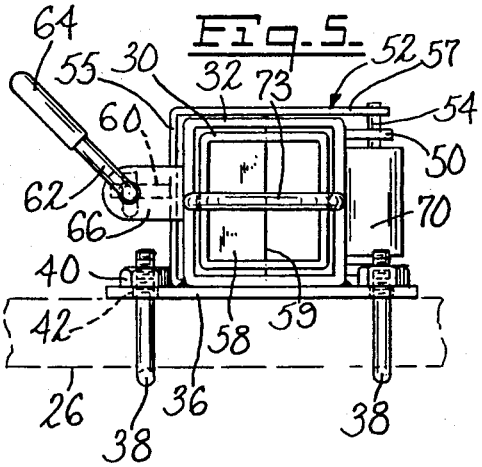
FIG. 5 is a top plan view of the safety extension and ladder rung of FIG. 1.
Figure 3:
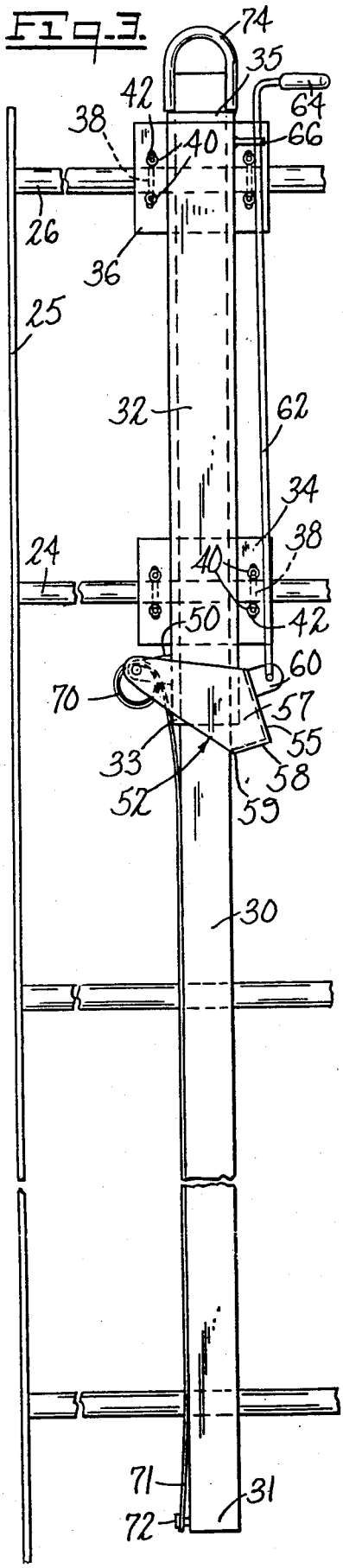
FIG. 3 is a rear elevational view of the safety extension of FIG. 2 attached to the rungs of a ladder, showing the extension in a retracted position.
Figure 4:
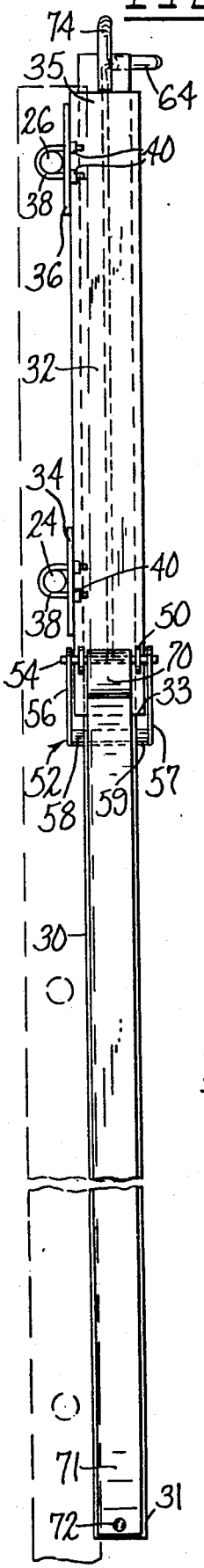
FIG. 4 is a side elevational view of the safety extension of FIG. 3 viewed from the left of FIG. 3.
Figure 7:
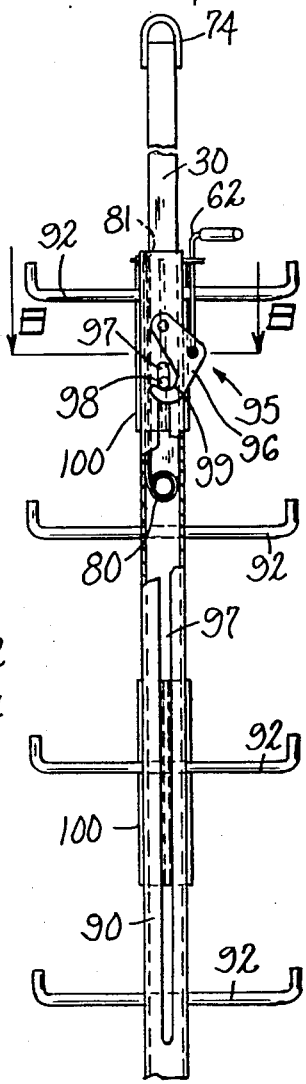
FIG. 7 is a rear elevational view of another alternate form of the safety extension in extended position, parts of the drawing being broken away to show detail.

A pair of plates, 34 and 36, rigidly attached to sleeve 32, the distance between the centers of the plates being substantially commensurate with the distance between adjacent ladder rungs. Each of plates 34 and 36 are adapted to receive threaded ends of U-shaped clamps 38 in recesses 42. Clamps 38 are dimensioned and shaped to be positioned around ladder rungs 24 or 26 and be secured to plate 34 and 36, as the case may be, by means of nuts 40 as illustrated in FIGS. 3, 4, and 5. It should be noted that the distance between plates 34 and 36 and the dimensions of clamps 38 as well as the location of recesses 42 are all established in relation to the ladder rungs 24 and 26. For most applications, a pair of U-clamps received in each plate is adequate to mount the safety extension to the ladder. The use of clamps 38 in the manner described also allows for the sleeve to be easily mounted in a central position relative to the ladder rungs. However, it is to be noted that a number of other means to attach the sleeve to the ladder or manhole wall may be provided or the sleeve may be integrated with the ladder structure as illustrated in FIG. 7 and more fully described below.

With further reference to FIG. 2, bracket 50 extends from the side of sleeve 32 below lower plate 34. A latch 52 is pivotally mounted to bracket 50 by means of pin 54. Latch 52 in a preferred form comprises a back 55 interposed between opposing sides 56 and 57. A stop 58 having edge 59 forms a lower surface extending between sides 56 and 57 adjacent to back 55. The sides and back of latch 52 roughly conform to the dimensions in lower sleeve end 33, so that in the position illustrated in FIG. 2, latch 52 extends around sleeve 32 and a portion of lower rod end 31 rests on stop 58.

Connector 60 extends outwardly from back 55. A release lever 62 pivotally connected to connector 60 extends in a substantially vertical direction to a point proximate upper sleeve end 35. The upper end of release lever 62 may be further provided with a handle 64 to facilitate the application of an upward vertical force to the release lever. A guide 66 may be provided to support the upper portion of the release lever.

A heavy duty coiled spring 70 is mounted to sleeve 32 proximate sleeve lower end 33. In a preferred form as illustrated in FIGS. 2–4, bracket 50 and pin 54 are used to secure spring 70 as well as latch 52. The open end 71 of spring 70 is attached at or near lower rod end 31 by means of bolt 72. Other means of attachment such as rivets or pins are also suitable.

Rod 30 and sleeve 32 have substantially uniform cross-sections and are dimensioned so that the rod exterior roughly conforms to the sleeve interior, with sufficient space to facilitate the longitudinal movement of rod 30 in sleeve 32. A lifting lug 74, which in a preferred form is in the form of an inverted U is mounted at the top of rod 30. Lug 74 functions to not only provide a convenient handle for lifting or pulling rod 30 relative to sleeve 32, but also functions as a check which when positioned against the top of sleeve end 35, prevents the further descent of rod 30 relative to sleeve 32.

It is to be noted that all of the foregoing components of the safety extension can be constructed of a rugged material such as steel, aluminum and metal alloys. One of the safety extension design parameters is the objective of providing a sturdy, heavy-duty safety extension which is capable of withstanding substantial stresses and forces.

In operation, the safety extension 10 may be mounted to ladder 20 by positioning clamps 38 around rungs 24 and 26 and by bolting clamps 38 to plates 34 and 36. The optimum position is generally obtained by mounting the safety extension to the top two rungs of the ladder and centrally positioning the extension between sides 23 and 25. The central position of the safety extension acts to facilitate and aid the user in maintaining a proper balance. This fixed, mounting arrangement, as depicted in FIGS. 2–6, is satisfactory in situations where the ladders to be fitted have the same rung spacing and rung diameter; however, if their rung dimensions vary appreciably, the fixedly spaced, prefabricated mounting plates 34 and 36 could, very well, not accommodate such a field variation. In those instances where job site rung dimension variations are expected, an adjustable mounting arrangement is preferred. Various alternative embodiments of an adjustable mounting means for the safety extension will be discussed in detail hereinafter.

The safety extension is moveable between an extended position illustrated in FIGS. 1 and 2 and a retracted position illustrated in FIGS. 3 and 4. With respect to use of the ladder, the operative mode for the safety extension is the extended position. The extension of the rod 30 is limited by bolt 72 striking the bottom edge of sleeve 32. At about the same time, the bottom edge of rod 30 passes above the edge 59 of stop 58 and the latch 52 falls by gravity to lock or hold the rod 30 in the extended position.

Figure 6:
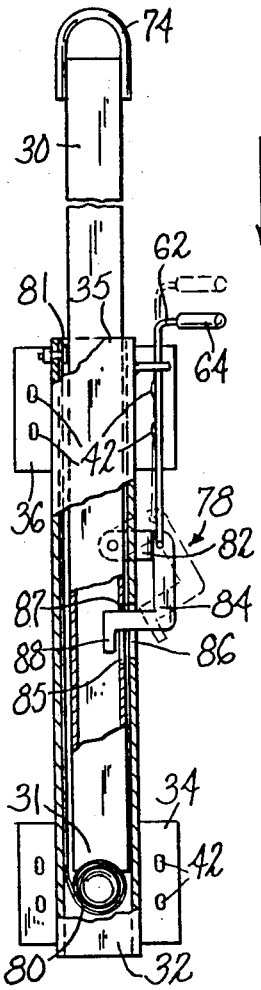
FIG. 6 is a rear elevational view of an alternate form of the safety extension in an extended position, parts being broken away and parts being illustrated in schematic form.

The safety extension may be retracted by exerting an upward force on the release lever 62 as illustrated schematically with respect to an alternate embodiment in FIG. 6. The upward vertical force translated to latch 52 results in latch 52 rotating to a position which is sufficient for stop edge 59 to move out of contact with lower rod end 31, so that the rod 30 is otherwise free to move downwardly relative to sleeve 32. Stop edge 59 will thus essentially slide against the side of rod 30 as shown in FIG. 3. The downward extend of rod 30 relative to sleeve 32 may be defined by the contact of the end of lug 74 against upper sleeve end 35, by the longitudinal extend of spring 70, or by the floor or other external obstruction. In preferred form of operation, the downward extent of rod 30 relative to sleeve 32 is limited by the positioning of lug 74 against upper sleeve end 35 as previously described.

By constructing the safety extension with heavy duty materials, the weight of rod 30 is substantial and could present a problem in lifting rod 30 from the retracted position to the extended position. The latter problem is particularly accute in the case of a manhole or below level environment where the extension user would be required to reach below his center of gravity to initially grasp lifting lug 74 and lift rod 30. Therefore, a counterbalancing means is provided to facilitate the movement of the rod to the extended position and while acting to prevent the unrestricted movement or free falling of the rod 30. In the mode illustrated in FIGS. 1–4, the counterbalance means is provided in the form of a heavy duty coiled spring 70 attached between the lower portions of sleeve 32 and rod 30 and upwardly biased to force lower rod end 31 toward lower sleeve end 33. While other counterbalancing means such as counterweights are within the scope of the invention, it is believed that the coiled spring mechanism as used in the instant invention provides both a heavy duty counterbalance and an efficient means of operation with the maximum of safety.

With reference to FIG. 6, an alternate orientation of coiled spring 80 is provided by attaching the free end 81 near the upper sleeve end 35 in the interior of sleeve 32 and securing the coiled end of spring 80 by positioning the coiled end below lower rod end 31. Lower rod end 31 may be provided with a cam surface or a similar surface to further facilitate the positioning and functioning of the spring.

Figure 9:
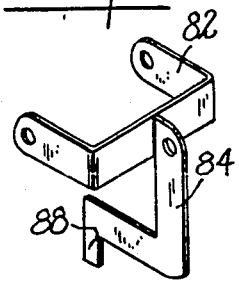
FIG. 9 is a perspective view of a portion of a latch mechanism employed in the safety extension of FIG. 6.

With further reference to FIGS. 6 and 9, an alternate gravitational latch mechanism 78 comprises a member 82 pivotally mounted at opposing ends to sides of sleeve 32. A clasp 84 attached to member 82 is dimensioned to be received in recesses 85 and 86 of rod 30 and sleeve 32, respectively. Upon reception of clasp 84 in recesses 85 and 86, rod recess surface 87 rests on clasp 84. Stop 88 extending downwardly from clasp 84 aids in maintaining clasp 84 in recesses 85 and 86 thus securing rod 30 in the extended position. Release lever 62 is pivotally connected to member 82. An upward vertical force on release lever 62 results in the clasp 84 being withdrawn from recesses 85 and 86, as shown schematically in FIG. 6, thus allowing the downward retraction of rod 30 relative to sleeve 32.

Figure 8:
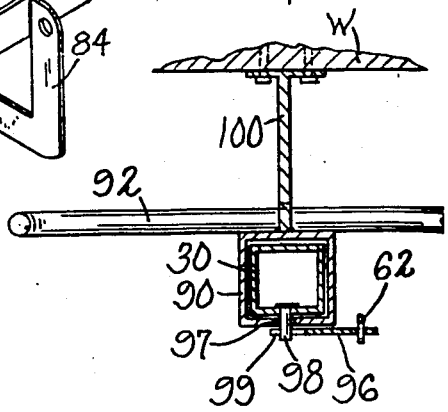
FIG. 8 is a sectional view of the safety extension of FIG. 7 along the line 8—8 of FIG. 7.

An alternate form of the safety device illustrated in FIGS. 7 and 8 is directed to sleeve 90 functioning, in addition to the previously described functions, as a support for ladder rungs 92. Rungs 92 preferably have upturned extremities. In this alternate embodiment, the safety extension and ladder are integrated structures. A counterbalance means such as that previously described with respect to FIG. 6 may be employed.

FIG. 7 also illustrates an alternate form of a latch means 95 for securing the rod in an extended position. Latch means 95 comprises a generally v-shaped clasp 96 pivotally mounted at one end to the side of sleeve 90. Clasp 96 has an interior cam surface 99 on the lower portion of the free end. Sleeve 90 is further provided with a central channel 97 which defines a path for key 98 extending outwardly from rod 30 and adapted to engage cam surface 99 which automatically latches by gravity. Clasp 96 may be released by means of an upward vertical force on release lever 62 in a manner previously described resulting in rod 30 dropping to a retracted position. Sleeve 90 may be rigidly mounted in fixed position against a passageway wall W by means of a plurality of supports 100 as illustrated in FIG. 8.

In many cases, fixed ladders which are commonly employed in manholes, hatchways and other below level passageways are of a non-standard design in that the spacing between adjacent ladder rungs vary, as well as the diameter of the rungs themselves. In order to overcome these variations in rung spacing and rung diameter and their attendant field fitting problems, my invention provides various presently preferred embodiments of an adjustable mount depicted in FIGS. 10–31 which easily accommodate rung dimension variations while minimizing field erection time and custom hardware.

Figure 10:
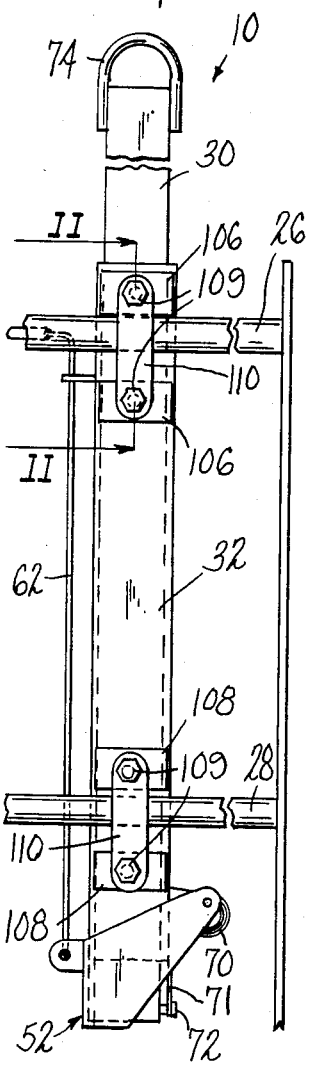
FIG. 10 is a front elevational view of the safety extension having one form of adjustable mounting means attached to the rungs of a ladder.
Figure 11:
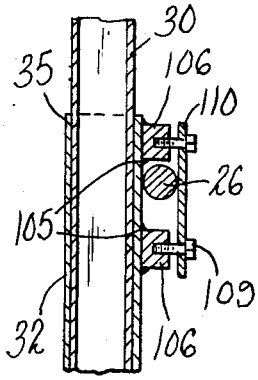
FIG. 11 is a cross-sectional view of an adjustable mounting arrangement taken along line 11—11 of FIG. 10.

One such presently preferred embodiment of my ladder safety extension with an adjustable mount is depicted in FIGS. 10 and 11. A pair of rigid, metal straps 110 are longitudinally, spaced apart along the sleeve 32 and bolted to a part of upper lugs 106 and a pair of lower lugs 108. The lugs 108 and 106 are secured to the sleeve 32 by way of a weld bead 105. The lugs 108, as well as the lugs 106, are spaced apart from one another at a sufficient distance so as to permit relative movement between the straps 110 and ladder rungs 26 and 28 in order to accommodate for any expected field variation in spacing between adjacent ladder rungs. The straps 110 are rigidly secured to the rungs of the ladder 26 and 28 by way of bolts 109, which threadably engage threaded holes formed in the lugs 106 and 108. As best seen in FIG. 11, this embodiment also accommodates variations in rung diameter due to the fact that the bolts 109 can be rotatably moved toward or away from the lugs 106 in order to compensate for any such variation.

Figure 12:
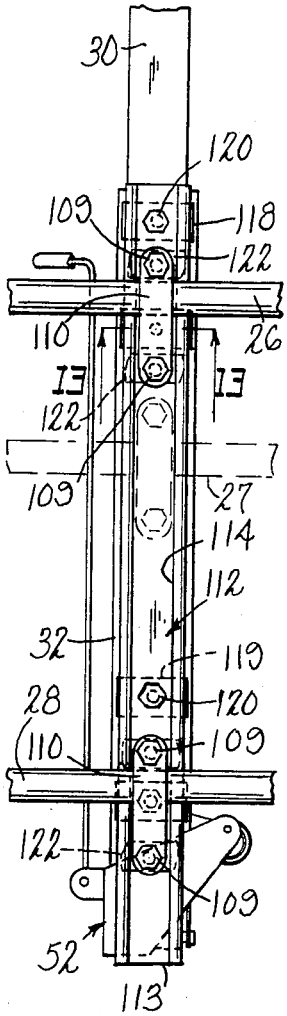
FIG. 12 is a front elevational view of the safety extension with another form of adjustable mounting construction attached to the rungs of a ladder.
Figure 13:
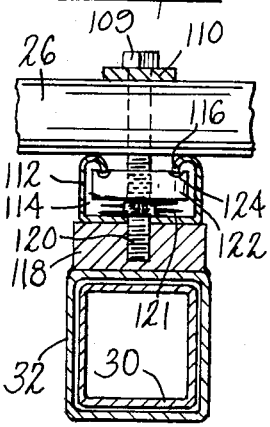
FIG. 13 is a sectional view of an adjustable mount taken along line 13—13 of FIG. 12.
Figure 14:
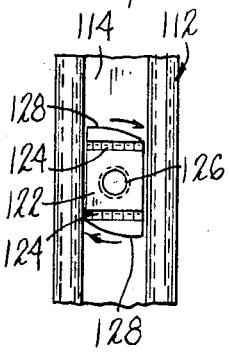
FIG. 14 is a partial front elevational view of a rotatable locking lug used in conjunction with a presently preferred embodiment of the adjustable mount.

Referring now to FIGS. 12–14, inclusive, another presently preferred embodiment of my ladder safety extension with an adjustable mount is shown. A rigid, preferably steel, longitudinally extending mounting channel 112 having a central, longitudinally extending slot 114 is secured by way of bolts 120 to a plurality of spacer elements 119. The spacer elements 119, in turn, are weldably secured to the sleeve 32 of the safety extension. As can be seen in FIG. 12, the mounting channel 112 extends over the entire length of the sleeve 32, with its lower most edge 113 extending slightly below the edge of the latch mechanism 52. Use of the spacer elements 119 and 118 places the mounting channel 112 in a spaced relationship relative to the sleeve 32 so as to prevent interference between the latch 52 and the channel edge 113 when the latch is pivoted. Mounted within the slotted interior 114 of the mounting channel member 112 are four moveable locking lugs 122. The moveable locking lugs 122 are commercially available and, as best seen in FIG. 14, are mounted within the slot 114 and slidably moved to any desired position therewithin. Once positioned, the lugs 122 are rotated 90° (as indicated by the arrows) along their cam surfaces 128 to a locked position. In the locked position, the ridged grooves 124 grippingly engage turned in edges 116 of the channel 112. Each locking lug 122 is also biased by a spring element 121 which engages the rear face thereof and maintains an upward force thereon to permit longitudinal sliding movement of the lug 122, while retaining the lug within the grooves 124. The lugs also contain a threaded hole 126 to engage bolts 109. The bolts 109, in turn, secure the straps 110 to the ladder rungs 26 and 28. As can be seen in FIG. 12, this embodiment affords a maximum amount of longitudinal movement between the straps 110 so as to accommodate a wide variation in rung dimensions, as indicated by the phantom representation of an oddly spaced ladder rung 27.

Figure 15:
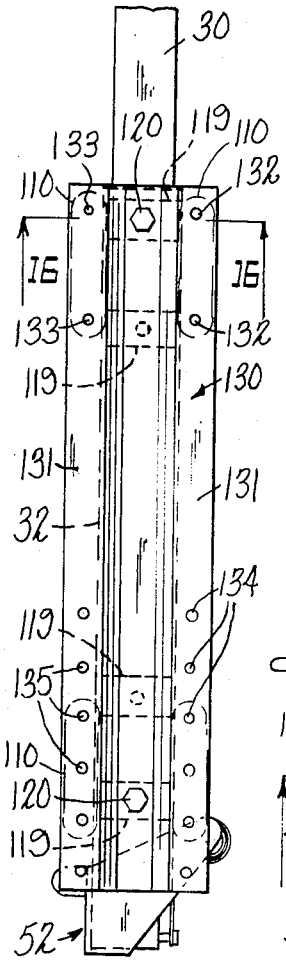
FIG. 15 is a front elevational view of the safety extension showing yet another alternate form of the adjustable mounting means.
Figure 16:
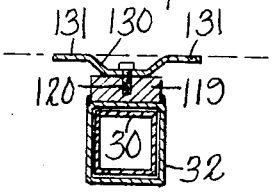
FIG. 16 is a sectional view of the adjustable mount taken along line 16—16 of FIG. 15.

Another alternate embodiment of my ladder safety extension with an adjustable mount is depicted in FIGS. 15–16 in which a unitary, longitudinally extending mounting channel 130 is secured to a plurality of spacers 119 by way of bolts 120. the spacers 119 are weldably secured to the sleeve 32 of the safety extension. The channel 130 carries a pair of outwardly extending opposed flanges 131 extending the length thereof, which have formed therethrough spaced apart pairs of upper bolt holes 132 and 133 and a plurality of spaced-apart, lower bolt holes 134 and 135. In this embodiment, a first pair of straps 110, shown in the phantom, are boltably secured through the holes 133 and 132 at the top of the channel and a second pair of bolting straps 110 also shown in phantom are mounted through any two matched holes 135 and 134, so as to accommodate the particular rung spacing encountered in the field. Further, in this embodiment, spacer elements 119 are utilized to prevent interference between the lower edge 129 of the channel 130 with the pivotal movement of the latch mechanism 52.

Figure 17:
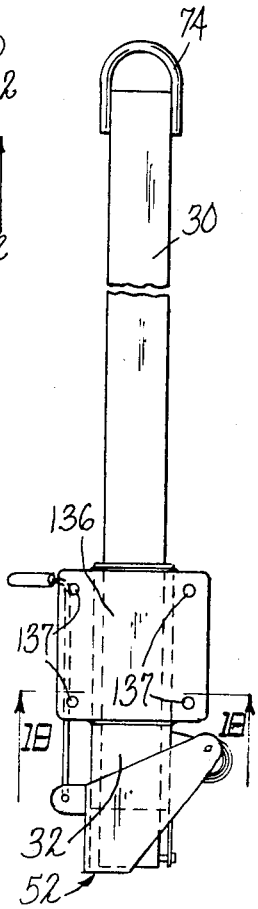
FIG. 17 is a rear elevational view of a safety extension adapted to be mounted to the wall of a manhole or like access.
Figure 18:
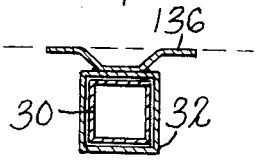
FIG. 18 is a sectional view of a mounting plate taken along line 18—18 of FIG. 17.

Still another embodiment of the safety extension mount of the present invention is depicted in FIGS. 17–18, in which the sleeve member 32 is provided with a mounting plate 136 suitable for directly mounting the unit, by way of bolt holes 137, to the side wall of a manhole or like subterranean accessway. It is contemplated that a plurality of such safety extensions, for example, four in number, could be mounted around the periphery of the subterranean access wall. With the extension rod 30 in the extended position, a safety rope (not shown) could be strung around the periphery of the access through the handle member 74. In this manner, the safety extension not only provides a hand-hold means for the workmen, but also functions as a barrier rope, warming device around the access hole, which is oftentimes required under various governmental safety regulations involving manholes. In this embodiment, the mounting plate 136 is welded directly to the sleeve 32.

Figure 20:
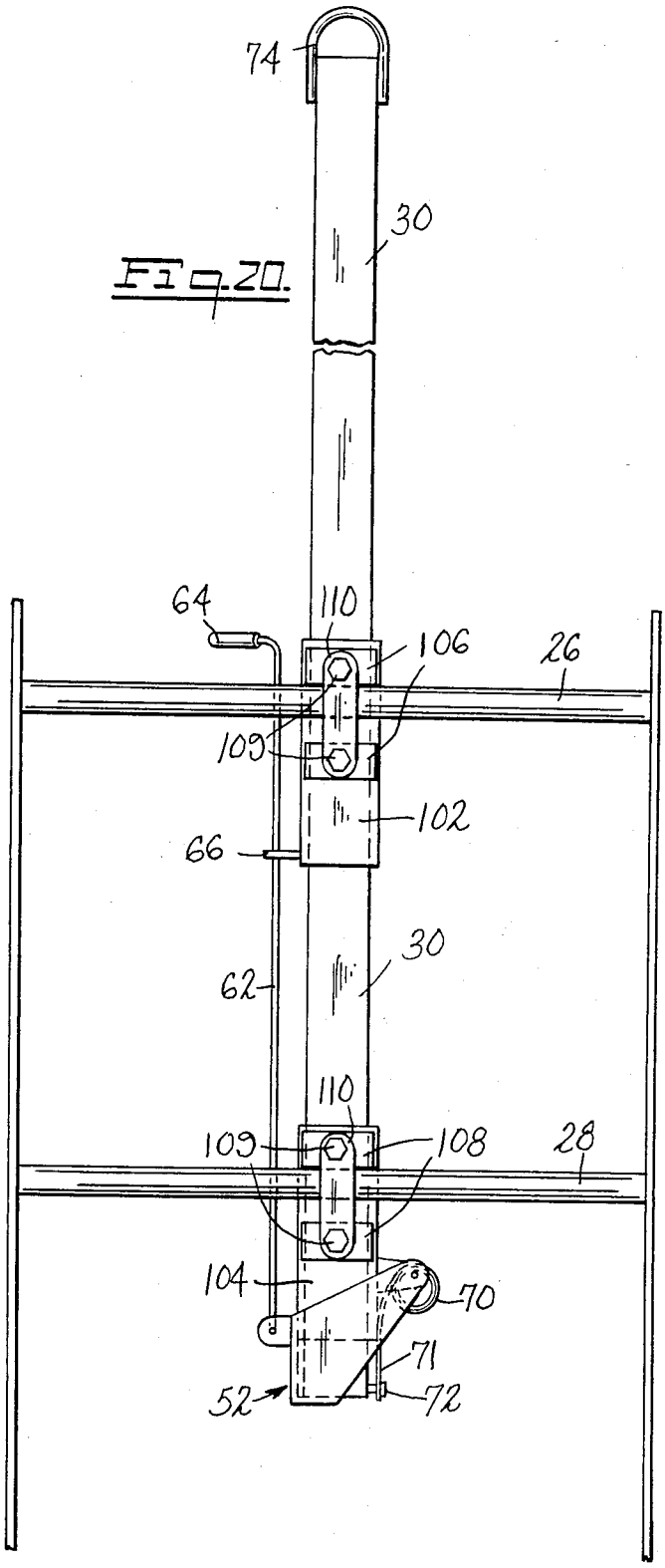
FIG. 20 is a front elevational view of the safety extension of FIG. 19 attached to the rungs of a ladder.
Figure 19:
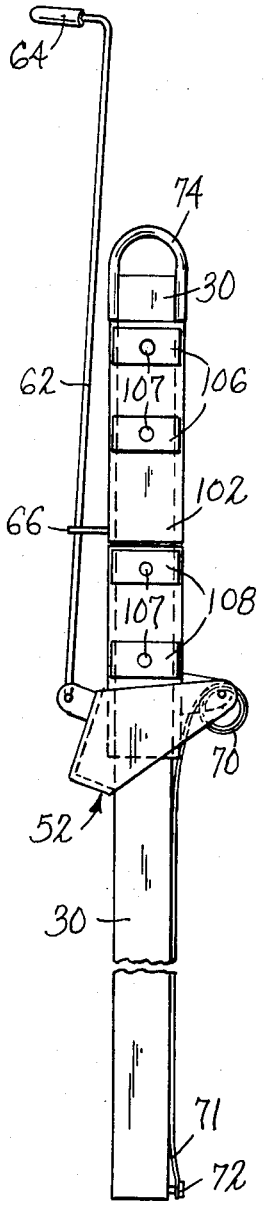
FIG. 19 is a front elevational view of a safety extension having two moveable sleeves, shown in the unmounted state.

A further alternate embodiment of my ladder safety extension with an adjustable mount is shown in FIGS. 19–20, in which the sleeve member of the safety extension comprises two portions, an upper sleeve 102 and a lower sleeve 104, within which the rod 30 is moveably received. Sleeve 102 carries a pair of welded upper spacer lugs 106 which have formed therein threaded bolt holes 107. The lower sleeve 104, likewise, carries a pair of lower spacer lugs 108 which also have threaded bolt holes 107 formed therein. Bolt holes 107 are adapted to receive bolts 109 in order to secure rung bolting straps (not shown) thereto. As can be seen in FIG. 20, the upper and lower sleeves 102 and 104, respectively, may be longitudinally moved to a spaced-apart position in order to accommodate various rung spacings which may exist between adjacent rungs 26 and 28.

Figure 21:
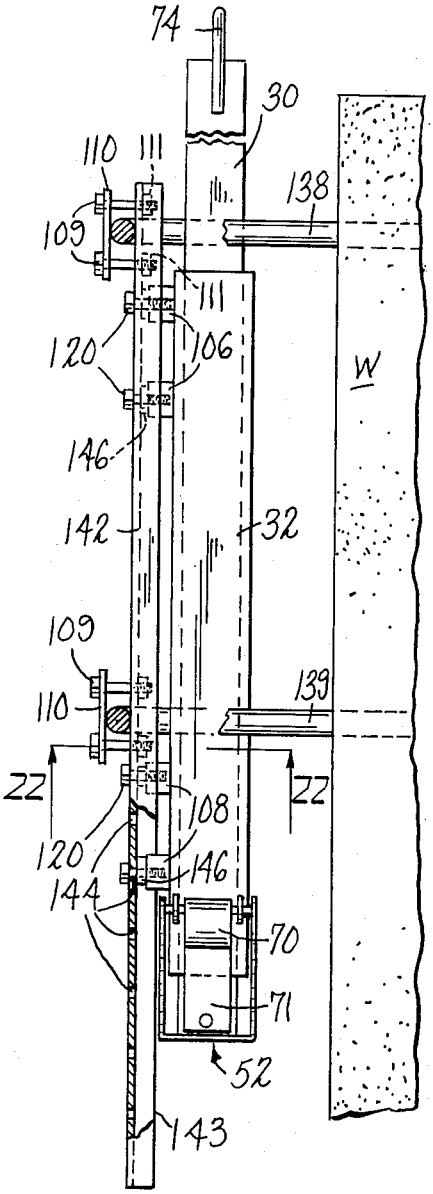
FIG. 21 is a side elevational view, partially sectioned and fragmented, showing the safety extension with still another form of an adjustable mounting arrangement attached to the rungs of a wall mounted ladder.
Figure 22:
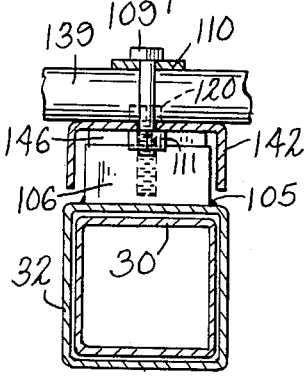
FIG. 22 is a sectional view of the adjustable mount taken along line 22—22 of FIG. 21.
Figure 23:
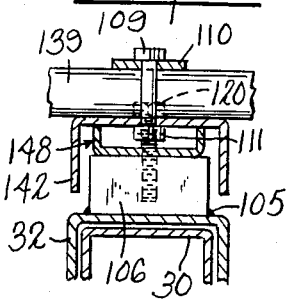
FIG. 23 is a sectional view of an alternate form of a mounting arrangement similar to FIG. 22.
Figure 24:
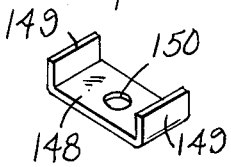
FIG. 24 is a perspective view of a spacer element utilized in the mount of FIG. 23.
Figure 25:
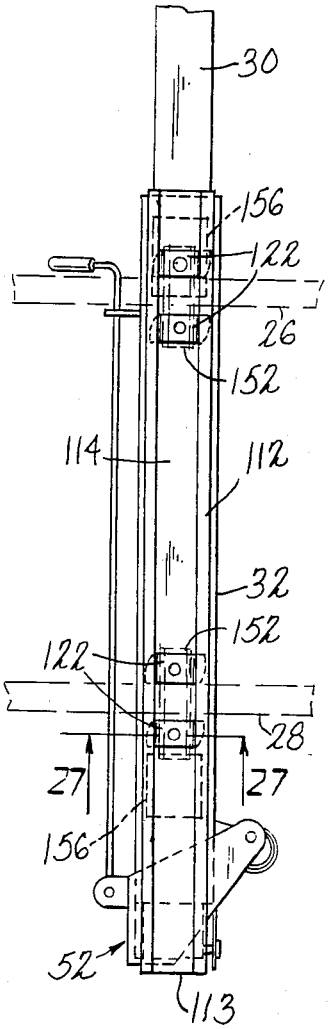
FIG. 25 is a front elevational view of the safety extension with another alternate form of an adjustable mount attached thereto.
Figure 26:
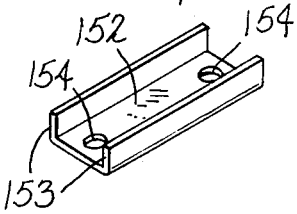
FIG. 26 is a perspective view of a presently preferred ladder rung attachment strap.
Figure 27:
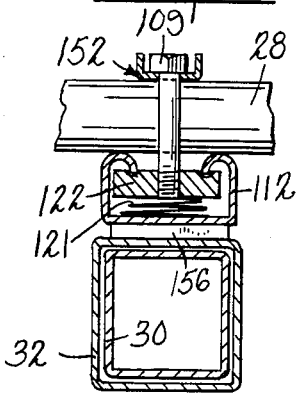
FIG. 27 is a sectional view of the adjustable mount taken along line 27—27 of FIG. 25.

While the above discussion has generally dealt with rung variations encountered in fixed ladders of the type having siderails, perhaps, the greatest variation in rung dimensions is encountered in those field installations where the ladder rungs are directly embedded into the side wall of the accessway. An installation of this type is shown in FIG. 21 wherein the ladder rungs 138 and 139 are embedded in the concrete side wall "W" of a manhole, or the like. An alternate safety extension mounting apparatus suitable for use in such an environment is depicted in FIGS. 21–24, which includes a U-shaped channel member 142 having a plurality of longitudinally extending, spaced apart bolt holes 144 formed through the face thereof. The longitudinally extending channel 142 includes a lower edge 143 which extends beyond the end of the latch 52 so as to provide a greater range of adjustability in order to accommodate a wide variety of spacings between the rungs 138 and 139. Referring to FIG. 22, the channel 142 is mounted to a plurality of spacer lugs 106 and 108 by way of bolts 120. The spacer lugs are attached to the sleeve 32 by way of weld 105. In order to insure proper clearance between the lower channel edge 143 and the pivotal movement of the latch 52, an additional spacer shim 146 is employed between the lugs 106 and 108 and the channel 142. A pair of bolting straps 110 are then snugly held in place against the ladder rungs by way of bolts 109 and accompanying nuts 111. A generally U-shaped spacer 148 shown in FIGS. 23 and 24, having extended leg portions 149 and a central bolt hole 150, may be employed in place of the spacer 146 as an alternate.

Figure 28:
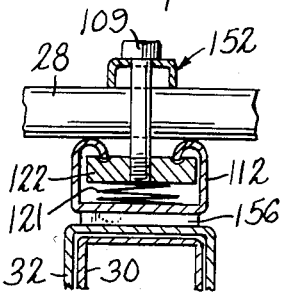
FIG. 28 is a sectional view of an adjustable mount similar to that of FIG. 27.

The adjustable attachment assembly depicted in FIGS. 25–28 is similar to the embodiment previously described in FIGS. 12–14. In this embodiment the longitudinally extending mounting channel 112 is weldably connected to a pair of spacers 156 which, in turn, are weldably secured to the sleeve 32 of the safety extension mechanism. Once again, the spacer elements 156 are required in order to insure clearance between the pivoting latch 52 and the lower end 113 of the mounting channel 112. A generally U-shaped, attachment or bolting strap 152, having upright leg portions 153 and bolt holes 154 employed in order to accommodate various ladder rung diameters. Specifically referring now to FIGS. 27 and 28, the bolting strap 152 may be positioned such that its leg portions 153 extend in a direction away from the rung 28 so as to insure a tight fit when the bolt 109 is tightened within the lug 122. On the other hand, if a smaller diameter ladder rung 29 is encountered, the bolting strap 152 can easily be inverted, as shown in FIG. 28, to accommodate the smaller diameter, while insuring a snug tightening of the bolt 109.

Figure 29:
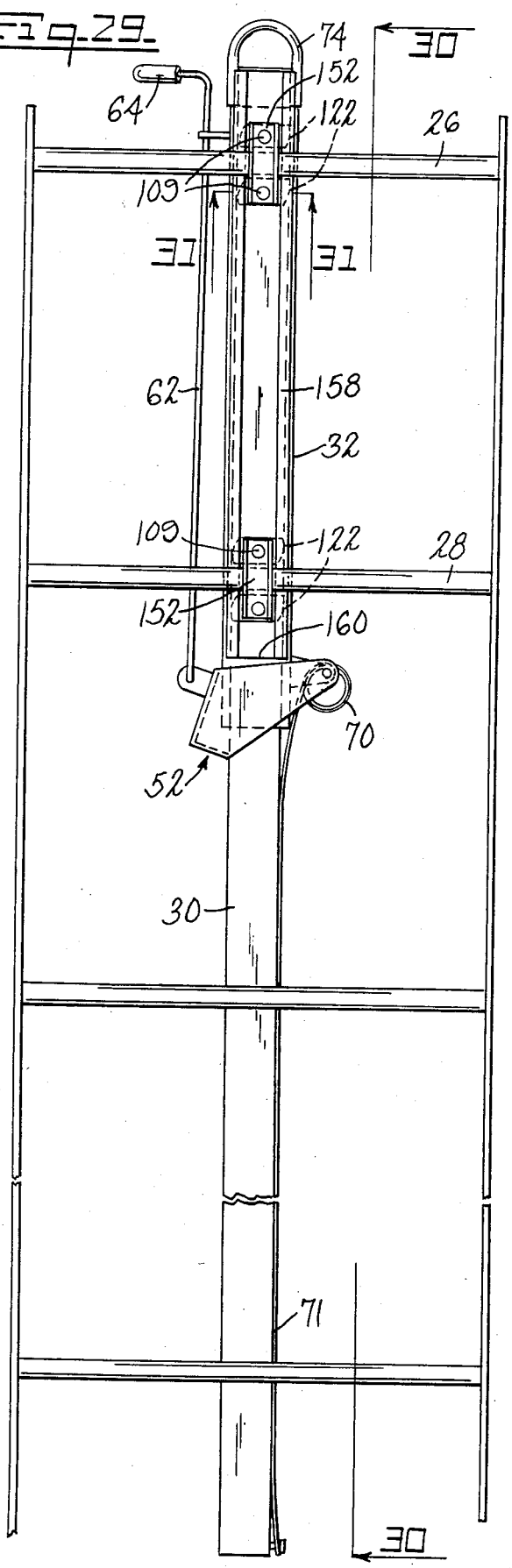
FIG. 29 is a front elevational view of a safety extension with another preferred form of an adjustable mount attached to the rungs of a ladder.
Figure 30:
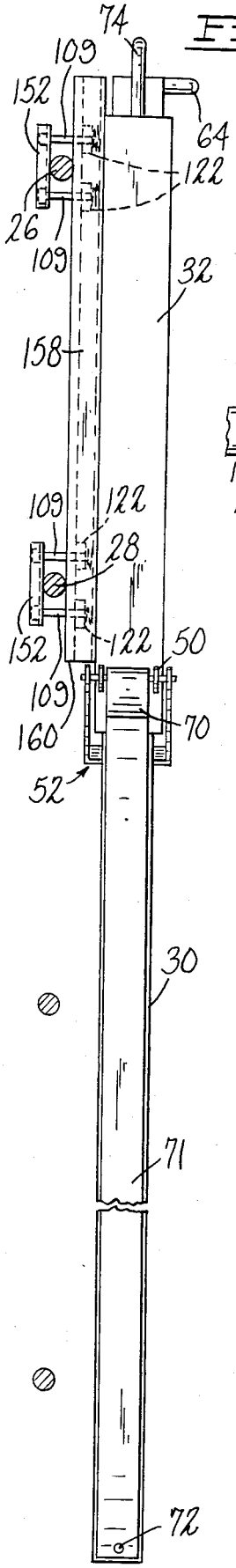
FIG. 30 is a side elevational view taken along line 30—30 of FIG. 29.
Figure 31:
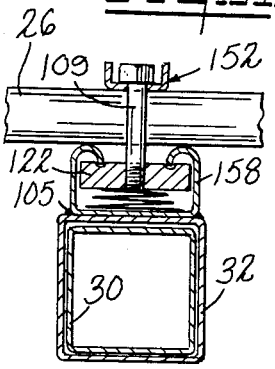
FIG. 31 is a sectional view of an adjustable mount taken along line 31—31 of FIG. 29.

A very simple and inexpensive adjustable attachment mount for a safety extension is shown in a presently preferred embodiment depicted in FIGS. 29–31. A longitudinally extending mounting channel 158 extends from the upper end of the sleeve 32 to a lower edge portion 160 which terminates above the latch mechanism 52. In this manner, no spacers need be employed between the mounting channel 158 and the sleeve 32. In view of this, the mounting channel 158 is directly attached, preferably, by way of weld 105 or the like to the sleeve 32. Previously described moveable locking lugs 122, of FIGS. 12–14, are employed along with the U-shaped attachment straps 152 and bolts 109. The adjustable mount construction shown in FIGS. 29–31 affords a wide range of longitudinal adjustment between the moveable channel straps 152 and, further, accommodates for variations in rung diameter through the use of the invertable U-shaped bolting straps 152. In addition, the bolts 109 are threadable adjustable within the locking lugs 122 to provide further movement.

It may thus be seen that the objects set forth as well as those made apparent from the foregoing description are efficiently attained. While preferred embodiments of the invention have been set forth for the purposes of disclosure, modifications of the disclosed embodiments of the invention, as well as other embodiments thereof may occur to those skilled in the art. Accordingly, the appended claims are intended to cover all embodiments of the invention which do not depart from the spirit and scope of the invention heretofore described.

I claim:

1. A safety extension for mounting on a wall or ladder comprising:

a sleeve;

an extension rod slidably mounted within said sleeve;

adjustable mounting means secured to said sleeve for attaching said sleeve to said wall or said ladder;

sleeve latch means for non-rotatably securing said extension rod within said sleeve in an extended position;

release means cooperatively attached to said latch means to allow disengagement of said latch and the movement of said extension rod from said extended position to a retracted position; and counterbalance means for facilitating the movement of said rod from said retracted to said extended position relative to said sleeve.

2. The safety extension of claim 1 wherein said adjustable ladder mounting means comprises:

at least one first ladder gripping means immovably secured to said sleeve for holding said sleeve to a rung of said ladder;

a second ladder gripping means containing a longitudinally adjustable gripping surface to accommodate said sleeve to various rung spacings and rung diameters; and means for attaching said first and second gripping means to said sleeve.

3. The safety extension of claim 2, wherein the gripping surface comprises a strap with two bolt holes and the means for attachment of the gripping surface comprises two lugs secured to the sleeve and two bolts through the bolt holes in the strap into the lugs.

4. The safety extension of claim 1, wherein at least some portion of the mounting means is longitudinally moveable with respect to the axis of the sleeve.

5. The safety extension of claim 4, wherein the mounting means comprises:

a longitudinally extending mounting member attached to the sleeve having a plurality of fixed, spaced-apart attachment points to accomodate variations in rung spacing;

a first means for gripping a ladder rung affixed to at least one of the attachment points; and at least one additional means for gripping a ladder rung affixed to at least one of the other attachment points.

6. The safety extension of claim 5 wherein the longitudinally extending mounting member comprises a mounting channel having a plurality of fixed, spaced-apart, pairs of bolt holes, and wherein the first means for gripping a ladder rung comprises at least one strap bolted to a corresponding pair of appropriately located bolt holes to grip the ladder rung between the mounting channel and the strap, and wherein the strap and the distance between the bolt holes are appropriately sized to accomodate variations in rung spacing.

7. The safety extension of claim 6, wherein the mounting channel has two outwardly extending flanges, each having a plurality of fixed, spaced-apart, pairs of bolt holes, and wherein the first means for gripping a ladder rung comprises a pair of straps bolted to a pair of appropriately located bolt holes in each flange, and wherein the straps and the distance are appropriately sized to accomodate variations in rung spacing.

8. The safety extension of claim 2 wherein the adjustable portion of the mounting means is longitudinally slidable with respect to the axis of the sleeve.

9. The safety extension of claim 8 wherein the mounting means comprises:

a longitudinally extending mounting member secured to the sleeve;

a first means for gripping a ladder rung slidably mounted on the mounting member; and at least one additional means for gripping a ladder rung mounted on the mounting member.

10. The safety extension of claim 8 wherein the sleeve comprises an upper half and a lower half capable of sliding independently relative to each other on the rod, and wherein at least one means for gripping a ladder rung is mounted on the upper half, and at least one additional means for gripping a ladder rung is mounted on the lower half.

11. The safety extension of claim 9 wherein the mounting member has a longitudinally extending slot defined by opposed inwardly turned edges and wherein the first means for gripping a ladder rung comprises at least one strap, at least one bolt through the strap, and at least one moveable locking lug slidably positioned within the slot and adapted to receive the bolt carried by the strap.

12. The safety extension of claims 3, 6, 7 or 11 wherein the strap or straps include upstanding leg portions which may be inverted to accomodate variations in rung diameter.

13. The safety extension of claims 5, 6, 7, 9 or 11 including a plurality of spacer elements between the mounting member and the sleeve to prevent interference with the operation of the latch means.

14. The safety extension of claim 1 wherein said sleeve and said rod have more or less rectangular cross sectional configurations to prevent inadvertent rotation of said rod within said sleeve.

15. A safety extension for mounting on a wall comprising:

a sleeve;

an extension rod slidably mounted within said sleeve and having an attachment point for a guard rope or the like at its upper end;

mounting means for attaching said sleeve to said wall;

sleeve latch means for non-rotatably securing said extension rod within said sleeve in an extended position;

release means cooperatively attached to said latch means to allow disengagement of said latch and the movement of said extension rod from said extended position to a retracted position; and;

counterbalance means for facilitating the movement of said rod from said retracted to said extended position relative to said sleeve.

16. A safety extension for a ladder comprising:

a sleeve;

an extension rod slidably mounted within said sleeve;

a mounting channel having a longitudinally extending slot defined by opposed inwardly turned edges;

a plurality of locking lugs movably positioned within said slot;

at least two means for gripping a ladder rung wherein each of said means is fastened to at least one of said locking lugs so that it tightly engages said inwardly turned edges of said mounting channel;

sleeve latch means pivotally attached at the lower end of said sleeve for securing said extension rod within said sleeve in an extended position;

release means cooperatively attached to said latch means to allow the disengagement of said latch and the movement of said extension rod to a retracted position; and counterbalance means for facilitating the movement of said rod from said retracted position to said extended position relative to said sleeve.

17. The safety extension of claims 1, 15 or 16 wherein said latch means comprises:

a bracket attached to the lowermost end of said sleeve;

a latch pivotally attached onto said bracket, said latch having dimensions more or less in conformance with those of said lowermost sleeve end; and stop means adapted to fit underneath said lowermost end when said rod is in an extended position to prevent said rod from being inadvertently moved into a retracted position.

18. The safety extension of claim 17 wherein said counterbalance means is a coiled spring rotatably mounted into said bracket and having one end attached to the lowermost end of said rod so that when said rod is lowered, said spring is uncoiled and biased toward contraction.

19. The safety extension of claim 17 wherein said latch operating means causes said stop to be rotated away from underneath the lowermost end of said sleeve so that said rod may be moved to a retracted position.

* * * * *